US009160074B2

(12) United States Patent
Desclos et al.

(10) Patent No.: US 9,160,074 B2
(45) Date of Patent: Oct. 13, 2015

(54) MODAL ANTENNA WITH CORRELATION MANAGEMENT FOR DIVERSITY APPLICATIONS

(71) Applicant: Ethertronics, Inc., San Diego, CA (US)

(72) Inventors: Laurent Desclos, San Diego, CA (US); Barry Matsumori, La Jolla, CA (US); Sebastian Rowson, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 316 days.

(21) Appl. No.: 13/674,137

(22) Filed: Nov. 12, 2012

(65) Prior Publication Data

US 2013/0147672 A1 Jun. 13, 2013

Related U.S. Application Data

(63) Continuation-in-part of application No. 13/029,564, filed on Feb. 17, 2011, now Pat. No. 8,362,962, which is a continuation of application No. 12/043,090, filed on Mar. 5, 2008, now Pat. No. 7,911,402, and a continuation-in-part of application No. 13/227,361, filed on Sep. 7, 2011, now abandoned.

(51) Int. Cl.

| | |
|---|---|
| ***H01Q 9/00*** | (2006.01) |
| ***H01Q 9/06*** | (2006.01) |
| ***H01Q 1/24*** | (2006.01) |
| ***H01Q 3/00*** | (2006.01) |
| ***H01Q 9/04*** | (2006.01) |

(52) U.S. Cl.

CPC ..... *H01Q 9/06* (2013.01); *H01Q 1/243* (2013.01); *H01Q 3/00* (2013.01); *H01Q 9/0421* (2013.01)

(58) Field of Classification Search

CPC ..... H01Q 3/00; H01Q 5/0072; H01Q 9/06
USPC ..... 343/700 MS, 745, 815, 817, 834
See application file for complete search history.

(56) References Cited

U.S. PATENT DOCUMENTS

| | | | | |
|---|---|---|---|---|
| 6,326,921 | B1 * | 12/2001 | Egorov et al. | 343/700 MS |
| 6,608,594 | B1 * | 8/2003 | Kane et al. | 343/700 MS |
| 6,809,686 | B2 * | 10/2004 | Du et al. | 343/700 MS |
| 7,705,786 | B2 * | 4/2010 | Iellici et al. | 343/702 |
| 7,990,319 | B2 * | 8/2011 | Boyle | 343/700 MS |
| 8,149,175 | B2 * | 4/2012 | Ryou et al. | 343/722 |
| 2004/0227667 | A1 | 11/2004 | Sievenpiper | |
| 2005/0059444 | A1 | 3/2005 | Martinez et al. | |
| 2009/0051611 | A1 | 2/2009 | Shamblin et al. | |
| 2009/0203396 | A1 | 8/2009 | Zhitnitsky | |
| 2010/0259456 | A1 | 10/2010 | Desclos et al. | |
| 2011/0274071 | A1 | 11/2011 | Lee | |
| 2014/0327578 | A1 * | 11/2014 | Rowson et al. | 342/368 |

FOREIGN PATENT DOCUMENTS

| | | |
|---|---|---|
| RU | 2354043 C2 | 4/2009 |
| WO | WO2009111511 | 9/2009 |
| WO | WO2011084717 | 7/2011 |

* cited by examiner

*Primary Examiner* — Tho G Phan
(74) *Attorney, Agent, or Firm* — Coastal Patent Law Group, P.C.

(57) ABSTRACT

Antenna systems comprising modal antennas for use in diversity and similar schemes include a modal antenna capable of multiple antenna modes wherein a distinct radiation pattern exists for each antenna mode, and a control signal for directing variation of the antenna modes. Methods for designing modal diversity antennas are further disclosed.

15 Claims, 14 Drawing Sheets

MODAL ANTENNA WITH CORRELATION MANAGEMENT FOR DIVERSITY APPLICATIONS

CROSS-REFERENCE TO RELATED APPLICATIONS

This application is a CIP of U.S. Ser. No. 13/029,564, filed Feb. 17, 2011, and titled "ANTENNA AND METHOD FOR STEERING ANTENNA BEAM DIRECTION", which is a CON of U.S. Ser. No. 12/043,090, filed Mar. 5, 2008, titled "ANTENNA AND METHOD FOR STEERING ANTENNA BEAM DIRECTION", now issued as U.S. Pat. No. 7,911,402; and a CIP of U.S. Ser. No. 13/227,361, filed Sep. 7, 2011, titled "MODAL ANTENNA WITH CORRELATION MANAGEMENT FOR DIVERSITY APPLICATIONS";

the contents of which are hereby incorporated by reference.

BACKGROUND OF THE INVENTION

1. Field of the Invention

This application relates generally to the field of wireless communication. In particular, this application relates to modal antennas adapted for diversity applications and methods for designing modal antennas for diversity or other scheme requiring two or more radiation patterns from the same or different location.

2. Related Art

As new generations of handsets and other wireless communication devices become smaller and embedded with increased applications (mobile internet browsing, software downloads, etc.), new antenna designs are required to address inherent limitations of these devices and to enable new capabilities. With classical antenna structures, a certain physical volume is required to produce a resonant antenna structure at a particular frequency and with a particular bandwidth. In multi-band applications, more than one such resonant antenna structure may be required. But effective implementation of such complex antenna arrays may be prohibitive due to size constraints associated with mobile devices.

Recent developments in the art have provided for steering of antenna radiation characteristics as is described in commonly owned U.S. patent application Ser. No. 12/043,090, titled "ANTENNA AND METHOD FOR STEERING ANTENNA BEAM DIRECTION", and filed Mar. 5, 2008; the entire contents of which are hereby incorporated by reference.

More recently, "beam steering antennas" have evolved toward applications for correcting situations where a wireless device may enter a location having little to no signal reception, otherwise known in the art as a "null" or "null field". When the device enters a null, the beam steering mechanism activates to steer antenna radiation characteristics into a useable state or mode. Thus, these "null steering antennas" have recently been referred to as "active modal antennas", or simply "modal antennas", due to the fact that these antennas provide various modes of operation, wherein a distinct radiation pattern exists for each antenna mode of the modal antenna. Antenna modes can be different and exhibit different radiation shapes but could also be configured to show more measured and continuous changes in radiation pattern characteristics.

To further understand the invention, one having skill in the art must be familiar with antenna diversity schemes. In the prior art, antenna diversity generally utilizes two or more antenna radiators in an effort to improve the quality and reliability of a wireless communication link. Often, especially indoors and urban canyons, the line of sight between a transmitter and receiver becomes saturated with obstacles such as walls and other objects. Each signal bounce may introduce phase shifts, time delays, attenuations, and distortions which ultimately interfere at the receiving antenna. Thus, destructive interference in the wireless link is often problematic and results in a reduction in performance.

Antenna diversity schemes can mitigate interference from multipath environments by providing multiple antennas to the receiver, and therefore multiple signal perspectives. Each of multiple antennas within a diversity scheme experiences a distinct interference characteristic. Accordingly, at a physical location where a first antenna may experience a null—the second antenna is likely to receive an effective signal. Collectively, the diversity scheme provides a robust link.

Antenna diversity can be implemented generally in several forms, including: spatial diversity; pattern diversity; polarization diversity; and transmit/receive diversity. Although each form is distinct, many antenna systems can be designed according to multiple forms.

Spatial diversity generally includes multiple antenna radiators having similar characteristics. The multiple antennas are physically spaced apart from one another. Where a first antenna may experience a significant reduction in signal reception, i.e. a null, a second antenna is adapted for use with the receiver.

Pattern diversity generally includes two or more co-located antennas with distinct radiation patterns. This technique utilizes directive antennas that are usually separated by a short distance. Collectively, these co-located antennas are capable of discriminating a large portion of angle space and may additionally provide relatively higher gain with respect to an omni-directional antenna element.

Polarization diversity generally includes paired antennas with orthogonal polarizations. Reflected signals can undergo polarization changes depending on the medium through which they are traveling. By pairing two complimentary polarizations, this scheme can immunize a system from polarization mismatches that would otherwise cause signal fade.

Transmit/Receive diversity generally includes the ability to provide diversity for both transmit and receive functions. Implementing transmit diversity can be more problematic due to the need for input from the base station or end side of the communication link regarding link performance.

Each of the above diversity schemes requires one or more processing techniques to effectuate antenna diversity, such as: switching, selecting, and combining. Switching is the most power-efficient processing technique which generally includes receiving a signal from a first antenna until the signal level fades below a threshold level, at which point a switch engages the second antenna radiator for communication with the receiver. Selecting is a processing technique which provides a single antenna signal to the receiver; however the selecting process requires monitoring of signal to noise ratio (SNR) or similar quantification for determining the ideal signal for utilization by the receiver. Combining is a processing technique wherein each of multiple signals are weighted and combined into an output signal for communication with the receiver. Although these techniques have been described for reception, their analogs are possible for transmit functions. Furthermore, a combination of these techniques is possible for dynamic diversity control.

Examples of prior art antenna diversity schemes can be recognized in FIGS. 1(*a-b*). FIG. 1*a* represents an architecture with two receive chains (two radiators) illustrating a minimum mean squared error (MMSE) combining technique. Here, the signal is weighted at each path and chosen to provide a minimum mean square between combined voltages. Alternatively, FIG. 1*b* represents an antenna architecture with two radiators for maximum ratio combining (MRC) processing. Here, a weighting factor is applied to each receive signal.

Although the above-described antenna diversity schemes can be implemented to provide a robust signal link, there are disadvantages associated with these current diversity architectures. For instance, size constraints can be significantly limited with multiple antenna radiators and coupling with nearby electronics of a communications device is a common problem with antenna system design. Additionally, power limitations and efficiency can be a problem in many instances where multiple paths are energized. Implementing 3 or more receive diversity or transmit diversity antennas only amplifies the problems related to volume required for additional antennas as well as circuit board area required for antennas and transmission lines. Receivers become more complicated as additional receive ports are implemented to accommodate larger numbers of antennas.

There has yet to be suggested in the art a diversity antenna scheme made up of a single antenna. In fact, prior art diversity architectures require two or more antenna radiators. With the advent of active modal antennas, the applicants herein disclose a single-antenna scheme for diversity and related applications, thereby providing a robust antenna with significantly reduced size for enabling compact wireless devices, inter alia.

SUMMARY OF THE INVENTION

The multi-mode antennas for diversity applications as described herein provide a single antenna and transmission line path to provide volume within the wireless device as well as area on the circuit board. A single receiver port can be used for this diversity scheme compared to the two or more required to implement more traditional diversity techniques. This single multi-mode structure can generate a multitude of radiating modes from a single antenna. With a single antenna diversity scheme, the antenna can be more optimally positioned for consideration of SAR (Specific Absorption Rate). The ability to generate multiple modes which result in multiple radiation patterns provides a method to improve antenna performance when against the user's head or in hand, in the case of a cell phone application. These modal diversity antennas can be similarly implemented in access points and other wireless devices. Throughput performance can be improved by optimizing envelope correlation coefficient (ECC) between the two or more modes generated.

In one aspect of the invention, an antenna is adapted for diversity operation at a single frequency band. The antenna generally includes a radiating structure disposed above a circuit board and forming an antenna volume therebetween. A first parasitic element is placed within the antenna volume and adapted to reactively couple to the radiating structure. The first parasitic element is further coupled with a first active element for varying a reactive coupling with the antenna radiator and thereby tuning the frequency response of the radiator. A second parasitic element is further provided and disposed outside of the volume of the antenna and adjacent to the radiating structure. The second parasitic element is further coupled with a second active element for varying a current mode thereon.

The antenna is configured to operate between two or more antenna modes. In a first antenna mode, the second parasitic element is in an open state; i.e. not connected to ground. In its first antenna mode, the antenna radiator will experience negligible de-tuning in frequency and in alterations to the radiation patterns. In a second antenna mode, the second parasitic element is short-circuited; i.e. connected to ground. The short-circuited parasitic element generates a split-resonance frequency response from the antenna. In combination, the second parasitic element is adapted to generate a split frequency response and the first parasitic element is adapted to shift the higher resonant frequency such that the antenna is adapted to operate at a target frequency in each antenna mode. The higher of the resonance frequencies of the antenna in the second antenna mode generates a distinct radiation pattern. Thus, the observable effect of placing the antenna in the second antenna mode includes a shift in the null locations as the second parasitic element is transitioned from an open to short-circuited state. In this regard, the antenna system having a single radiating structure is capable of diversity operation at a desired frequency band and adapted to provide a robust link across a wireless platform.

In a practical sense, the diversity antennas described herein can be incorporated into wireless communications devices such as: cellular phones, portable electronic devices, access points, laptops, Pad devices, and more. These antennas can be configured for one or more diversity applications, such as: receive diversity; transmit diversity; and transmit and receive diversity; wherein null steering functions of the antenna enable diversity applications over a single radiator architecture. In this regard, benefits such as conservation of space and energy translate into low cost and high performance wireless solutions. Additionally, the correlation coefficient can be varied dynamically to optimize as a function of frequency. The correlation coefficient can be adjusted to compensate for the effects of hand and head loading of the wireless device as the device is used in multiple use cases.

In one embodiment, the antenna includes a radiating structure disposed above a circuit board and forming an antenna volume therebetween. A first parasitic element is positioned within the antenna volume and configured to provide a tuned reactance such that the antenna operates at a desired frequency band. A second parasitic element is positioned outside of the antenna volume and adjacent thereto. The second parasitic element is adapted to induce a split-resonance frequency response of the radiating structure. The first parasitic element and second parasitic element are each connected to a common active element. In a first state, the active element maintains the second parasitic element in a first antenna mode, wherein the antenna is adapted to operate at a desired frequency band. In a second state, the active element short-circuits the second parasitic element, thereby inducing a split-frequency response of the antenna radiator. Furthermore, the first parasitic couples to the antenna radiator for shifting the frequency response of the antenna such that one of the resonance frequencies of the antenna in the second antenna mode is tuned for operation at the desired frequency band. In this regard, the antenna operates at a desired frequency band while in each of two or more antenna modes. Furthermore, the second mode provides a distinct radiation pattern and thereby provides a mechanism for null steering of the antenna.

Alternatively, each of the parasitic elements can be attached to a distinct active element. In each of the embodiments herein, the active element can comprise one or more of the following: voltage controlled tunable capacitors or inductors, voltage controlled tunable phase shifter, FET's and switches . . . .

In another embodiment, a receive diversity architecture is provided; the antenna includes a radiating structure positioned above a circuit board and forming an antenna volume therebetween. A first parasitic element is positioned within the antenna volume. A second parasitic element is positioned outside of the antenna volume and adjacent to the antenna radiator. This architecture can be referred to as a null-steering antenna. The null steering antenna is connected to a duplexer, and the duplexer is in communication with a receiver and a transmitter. A baseband control signal is provided to the antenna. The baseband influences activity of the one or more active elements contained within the antenna system. As mentioned above, a single active element can control both the first and second parasitic elements; or alternatively, two or more active elements can be provided with at least one of the active elements individually attached to each of the parasitic elements. In this regard, the antenna mode can be actively controlled using a baseband signal in combination with a modal antenna.

Each of the parasitic elements can be individually positioned parallel to the antenna radiator, or offset at any angle with respect thereto. The parasitic elements can be positioned parallel to one another, or at any orientation with respect thereof. The second parasitic element can be positioned at a distance above the circuit board ($H_{par}$) which is greater than the distance above the circuit board ($H_{ant}$) for which the antenna radiator is disposed.

The radiating structure can comprise an Isolated Magnetic Dipole (IMD) antenna, Planar Inverted F-Antenna (PIFA), dipole, monopole, loop, meanderline, or other antenna known in the art. In this regard, an IMD antenna may provide better isolation and may therefore be preferred for applications where strict volume requirements are present or where the antenna must fit within a small volume sharing other circuitry.

Furthermore, the antenna radiating structure, first parasitic element, and second parasitic element can be at least partially disposed above a ground plane. Alternatively, a ground connection can replace a ground plane. One or more slots can be etched in the ground plane, or portions of the ground plane can be removed.

In certain embodiments, the antenna system may comprise a processor or CPU for controlling functions of the one or more active elements and attached parasitic elements. A baseband signal can be provided to the processor and programmatically delivered to one or more active elements and attached parasitic elements. In this regard, one or more algorithms can be programmed to supply a multitude of functions to the antenna. Furthermore, the processor provides a mechanism for dynamic adjustment of the reactive loading configuring each of the parasitic elements. Dynamic adjustment of the modal antenna provides improved throughput and performance.

Another aspect of the present invention relates to a method for designing a modal antenna for diversity applications. The method comprises providing an antenna radiating structure positioned above a circuit board and forming an antenna volume therebetween; optimizing a position and orientation of a second parasitic element within the antenna volume for configuring the antenna for operation at a desired frequency band; and optimizing a distance and orientation of a second parasitic element for providing a useable radiation pattern influence wherein the antenna is capable of operation at the desired frequency band with a combined use of the parasitic elements.

Another aspect of the present invention relates to a method for designing a modal antenna adapted for diversity applications comprising a null steered antenna and an additional antenna to provide an additional diversity port. The method comprises providing a first antenna radiating structure positioned above a circuit board and forming an antenna volume therebetween; optimizing a position and orientation of a second parasitic element within the antenna volume for configuring the antenna for operation at a desired frequency band; and optimizing a distance and orientation of a second parasitic element for providing a useable radiation pattern influence wherein the antenna is capable of operation at the desired frequency band with a combined use of the parasitic elements. A second antenna is positioned at a distance from the first antenna. The null steered antenna provides multiple antenna modes, with the second antenna providing an additional receive path for an additional diversity receiver port.

Another aspect of the present invention relates to the creation of a data base that relates antenna efficiency and envelope correlation coefficient (ECC) to diversity gain for a null steered receive diversity configuration. This data base can be loaded in memory located in the wireless device and used to dynamically tune and improve receive performance by optimizing efficiencies and ECC of the receive diversity antenna configuration. This data base can also be generated to represent receive diversity antenna system performance for multiple use cases such as wireless device in user's hand, against user's head, or positioned on a surface such as a table; these use cases relate to a diversity antenna system installed in a cell phone, for example.

Another aspect of the present invention relates to an algorithm developed and implemented with the data base containing antenna efficiency and ECC data that monitors system receive performance and tunes the null steered antenna to optimize data throughput and/or receive system sensitivity. The algorithm can be developed such that system data throughput is monitored and a series of preset tuning commands are supplied to the active components in a null steered diversity antenna to adjust antenna parameters (efficiency and ECC) to optimize throughput.

An algorithm can be implemented such that inputs from sensors on the wireless device, such as proximity sensors, can be analyzed and used to select tuning commands to optimize null steered antenna throughput performance. The proximity or other sensors are used to determine the environment that the wireless device is operating in: wireless device in user's hand, against user's head, in a specific angle or orientation in relation to a reference orientation. Body loading and polarization effects can be compensated for with the dynamic tuning available in the null steered antenna architecture.

BRIEF DESCRIPTION OF THE DRAWINGS

The invention can be further understood upon review of the following detailed description in conjunction with the appended drawings, wherein:

FIG. 1(*b*) illustrates an antenna diversity scheme having two antennas and a combiner for maximum ration combining (MRC).

FIG. 2(*b*) illustrates a frequency characteristic plot according to various antenna modes of the antenna according to FIG. 2(*a*).

FIG. 2(*c*) illustrates a radiation pattern characterized by a first antenna mode associated with the antenna of FIG. 2(*a*).

FIG. 2(*d*) illustrates a radiation pattern characterized by a second antenna mode associated with the antenna of FIG. 2(*a*).

FIG. 3(*b*) illustrates an example of a null-steering antenna adapted for diversity applications in accordance with the embodiment illustrated in FIG. 3(*a*).

FIG. 4(*b*) illustrates an efficiency plot characterized by a first antenna mode according to the antenna of FIG. 3(*b*).

FIG. 4(*c*) illustrates a plot of return loss characterized by a second antenna mode according to the antenna of FIG. 3(*b*); wherein the second parasitic element is short-circuited.

FIG. 4(*d*) illustrates an efficiency plot characterized by a second antenna mode according to the antenna of FIG. 3(*b*).

FIG. 4(*e*) illustrates a combined plot of efficiency and correlation coefficient relating the first and second modes as set forth in FIGS. 4(*a*)-4(*d*).

DETAILED DESCRIPTION OF THE PREFERRED EMBODIMENTS

Figure 1A:
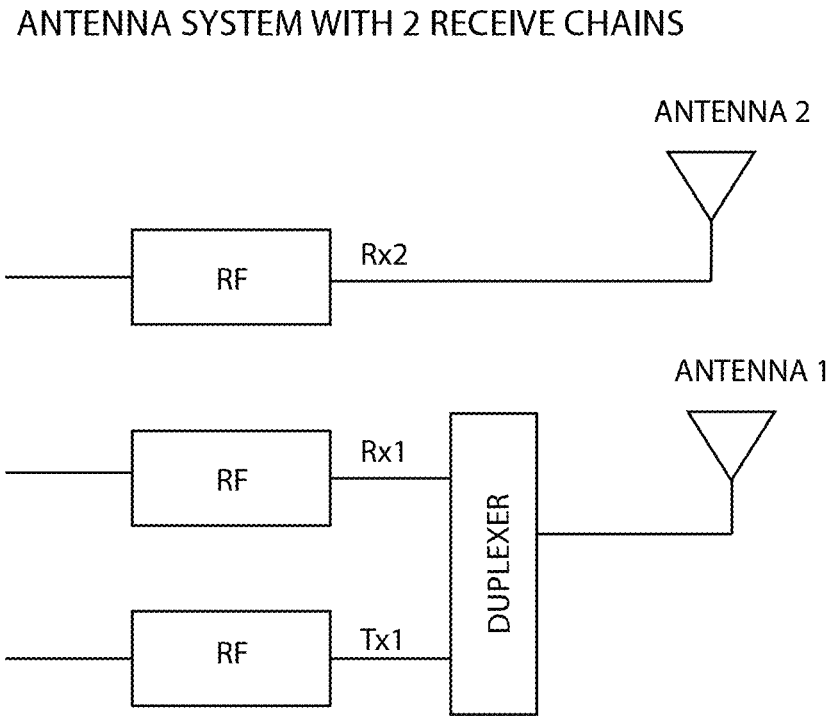
FIG. 1(*a*) illustrates an antenna diversity scheme having two antennas adapted for minimum mean square error combining (MMSE).
Figure 1B:
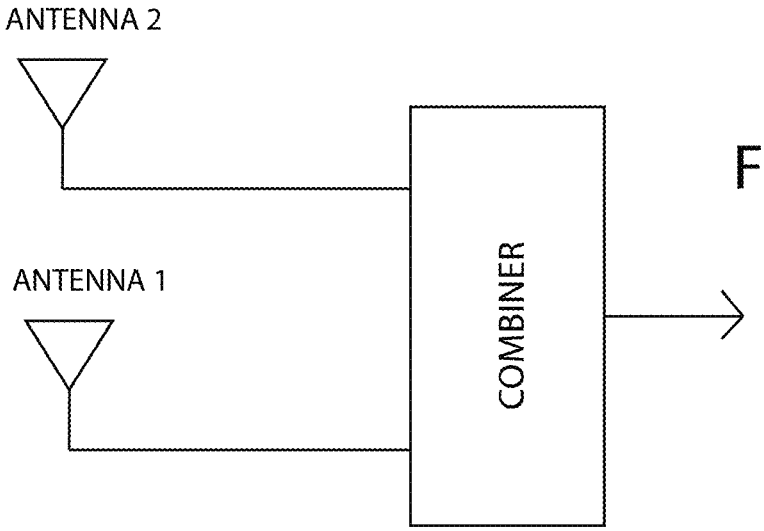
Figure 2A:
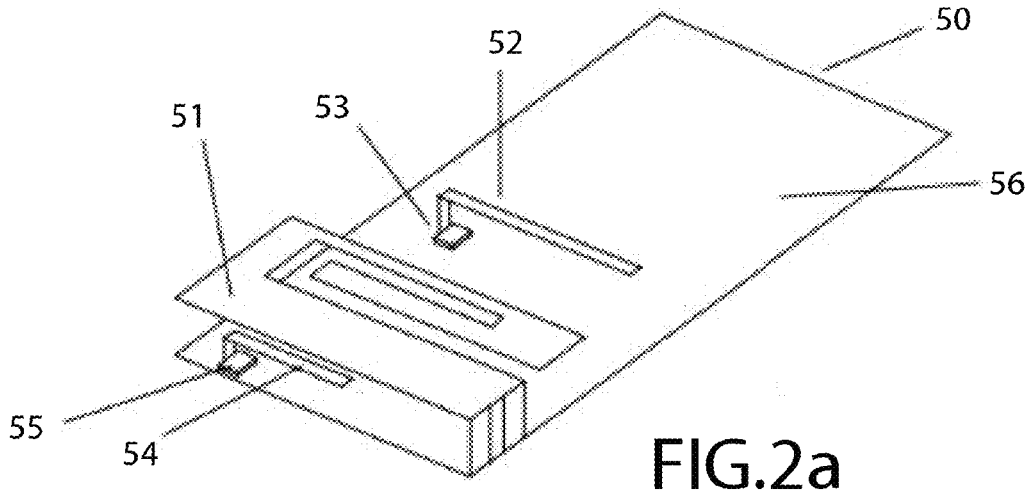
FIG. 2(*a*) illustrates a null-steering antenna comprising a single radiator, a first parasitic element and a second parasitic element.
Figure 2B:
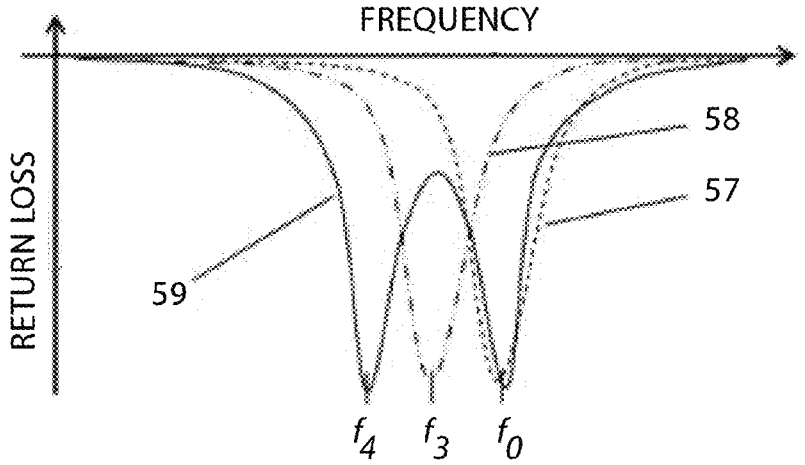
Figure 2C:
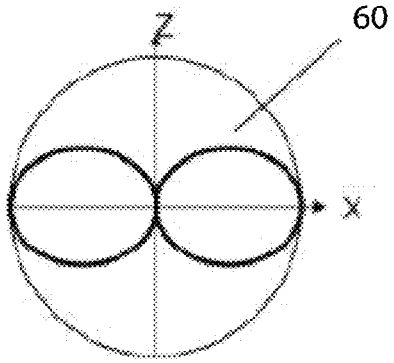
Figure 2D:
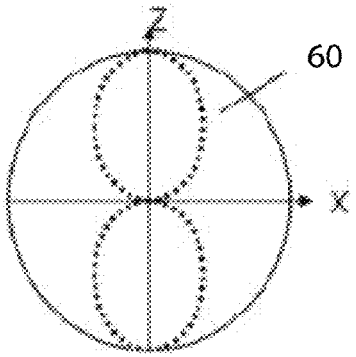

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

One solution for designing more efficient antennas with multiple resonant frequencies is disclosed in commonly owned U.S. Pat. No. 7,830,320, where an Isolated Magnetic Dipole™ (IMD) is combined with a plurality of parasitic and active tuning elements that are positioned under the IMD. With the advent of a new generation of wireless devices and applications, however, additional capabilities such as beam switching, beam steering, space or polarization antenna diversity, impedance matching, frequency switching, mode switching, and the like, need to be incorporated using compact and efficient antenna structures. The present invention addresses the deficiencies of current antenna designs in order to create more efficient antennas with null-steering and frequency tuning capabilities across diversity applications.

Modal Antennas

Referring to FIGS. 2(*a-d*), a modal antenna is provided. FIG. 2(*a*) illustrates an IMD element 51, which is situated on a ground plane 56, a second parasitic element 52 that is coupled with an active element 53, and a first parasitic element 54 that is coupled with a second active element 55. In this exemplary embodiment, the active elements 53 and 55 may comprise two state switches that either electrically connect (short) or disconnect (open) the first and second parasitic elements to the ground. In combining the first and second parasitic elements, the antenna 50 can advantageously provide the frequency splitting and null steering capabilities of the former with frequency shifting capability of the latter.

FIG. 2(*b*) illustrates the frequency characteristic 59 associated with the exemplary embodiment of antenna 50 shown in FIG. 2(*a*) in three different states. The first state is illustrated as frequency characteristic 57 of a simple IMD, obtained when both first and second parasitic elements 52 and 54 are open, leading to a resonant frequency $f_0$. The second state is illustrated as frequency shifted characteristic 58 associated with antenna 50 of FIG. 2(*a*), obtained when the first parasitic element 54 is shorted to ground through switch 55. The third state is illustrated as a double resonant frequency characteristic 59 with resonant frequencies $f_4$ and $f_0$, obtained when both the first and second parasitic elements 52 and 54 are shorted to ground through switches 53 and 55. This combination enables two different modes of operation, but with a common frequency, $f_0$. As such, operations such as null-steering may be readily effected using the exemplary configuration of FIG. 2.

It has been determined that this null-steering technique produces several dB signal improvement in the direction of the null. FIG. 2(*c*) illustrates the radiation pattern at frequency $f_0$ associated with the antenna 50 of FIG. 2(*a*) in the third state (all short), which exhibits a ninety-degree shift in direction as compared to the radiation pattern 61 of the antenna 50 of FIG. 2(*a*) in the first state (all open) (shown in FIG. 2(*d*)). As previously discussed, such a shift in radiation pattern may be readily accomplished by controlling (e.g., switching) the antenna mode through the control of parasitic element 52, using the active element 53. By providing separate active tuning capabilities, the operation of the two different modes may be achieved at the same frequency. This type of null-steering antenna is further described in commonly owned U.S. Ser. No. 12/043,090.

For purposes of this invention, the first state of the antenna (all open) may be described hereinafter as the "first antenna mode". In the first antenna mode, the antenna exhibits a single resonance as both the first and second parasitic elements are open (disconnected from ground). Furthermore, and for purposes of this invention, the third state (all closed) may be described hereinafter as the "second antenna mode" of the antenna. In the second antenna mode, the antenna exhibits a split resonance characteristic shifted along the frequency axis to adapt the antenna for operation over a common frequency band between the two antenna modes. It should be noted, however, that the radiation pattern of each antenna mode is distinct and therefore the antenna is adapted for null-steering.

Although an IMD-type modal antenna is described, it should be noted that any antenna radiator combined with an actively adjustable parasitic element to form an active modal antenna may be similarly used. In this regard, any modal antenna may be implemented in similar fashion as the described examples, without limitation.

Modal Antenna Adapted for Receive Diversity Application at Single Frequency

With additional design, circuitry, and hardware, the modal antennas described above have been adapted for diversity applications and the applicants have successfully developed a functional model which is described herein. With this distinct approach to antenna diversity, a single radiator is capable of diversity signal processing and adapted to provide reduced power requirements and smaller form factor within wireless communications devices.

In certain embodiments disclosed herein, active elements can include any of: switches, voltage controlled tunable capacitors, voltage controlled tunable phase shifters, varactor diodes, PIN diodes, MEMS switches, MEMS tunable capacitors, BST tunable capacitors, and FET's.

Figure 3A:
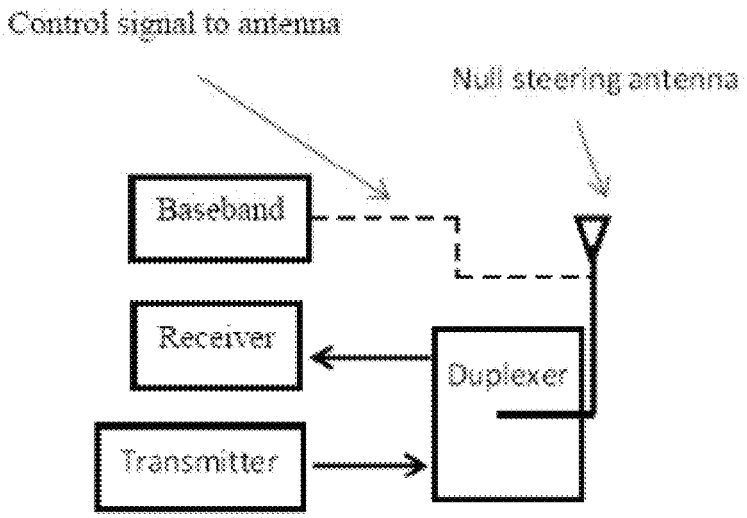
FIG. 3(*a*) illustrates a schematic of a null-steering antenna adapted for diversity applications according to an embodiment of the invention.
Figure 3B:
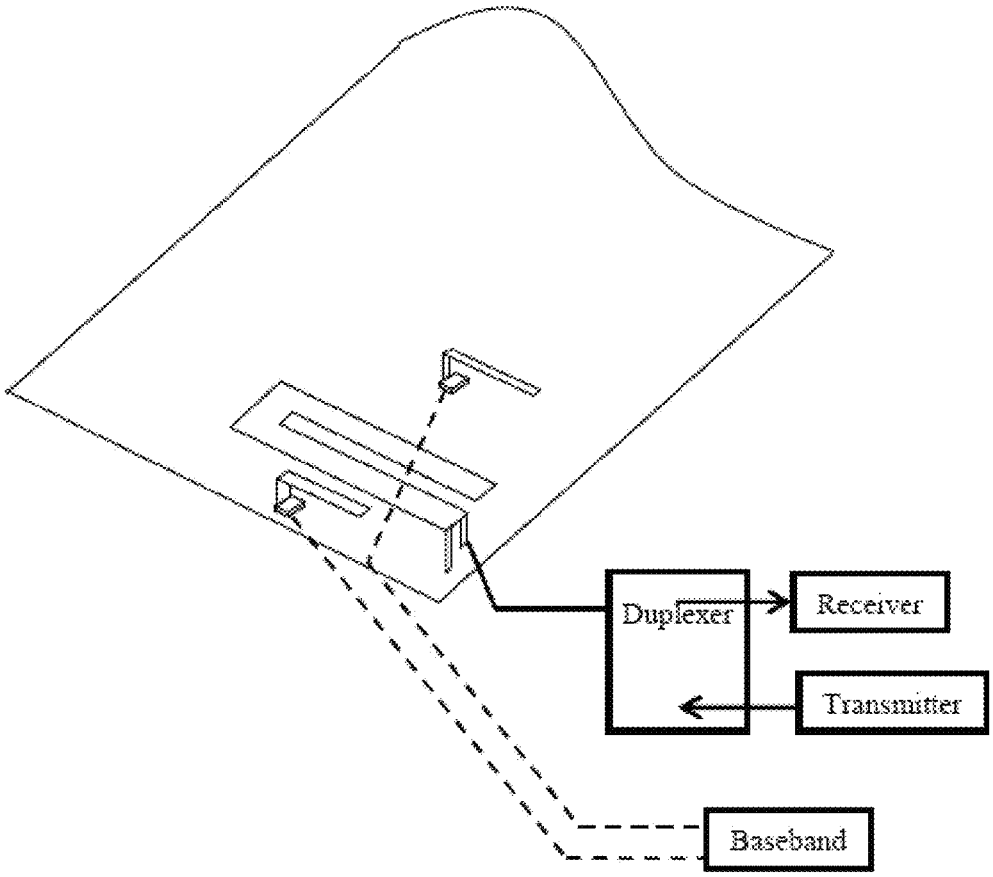
Figure 4A:
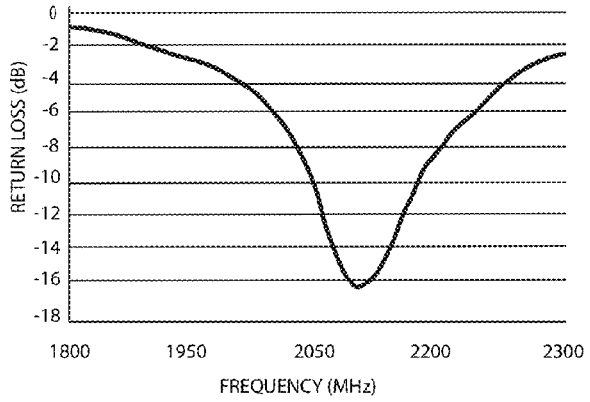
FIG. 4(*a*) illustrates a plot of return loss characterized by a first antenna mode according to the antenna of FIG. 3(*b*); wherein the second parasitic element is in an open-circuit configuration.
Figure 4B:
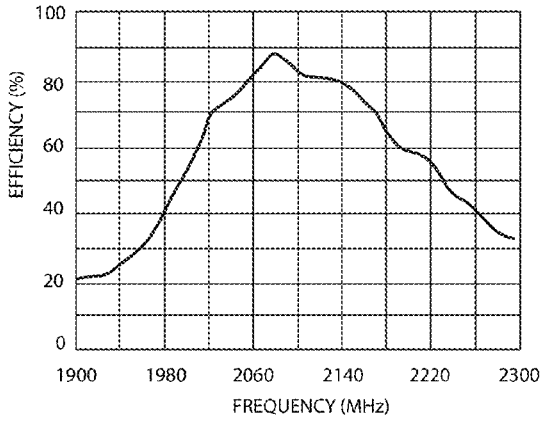
Figure 4C:
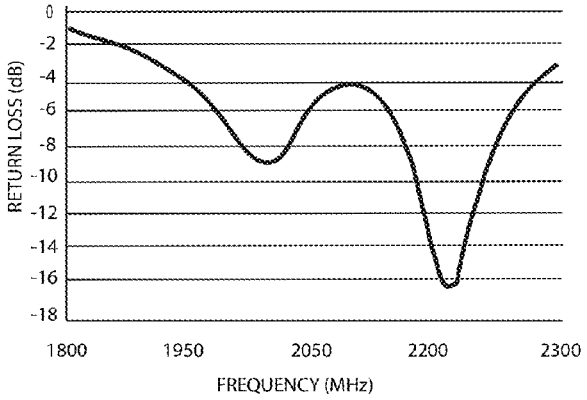
Figure 4D:
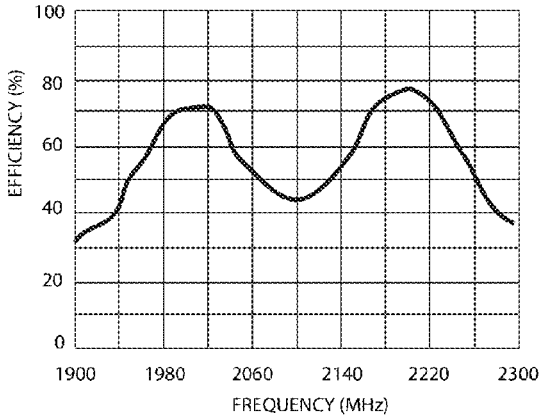
Figure 4E:
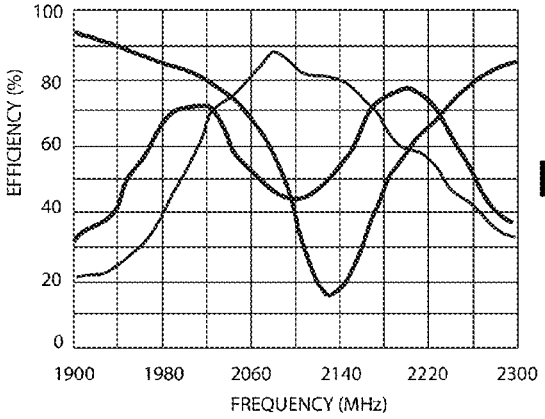

Now turning to FIGS. 3(*a-b*), a modal antenna system adapted for diversity applications is provided. A general schematic according to one embodiment of the invention, as illustrated in FIG. 3(*a*), provides a single antenna radiator in communication with at least one of a receiver and transmitter, through a duplexer where necessary to prevent damage to sensitive receiver components. The antenna radiator is further connected to a baseband control signal, thereby providing a control mechanism for diversity processing.

The antenna system is further illustrated in the embodiment of FIG. 3(*b*), wherein the antenna system comprises an antenna radiator disposed above a circuit board forming an antenna volume therebetween. A first parasitic element is positioned within the antenna volume near enough to reactively couple to the antenna for providing a frequency-shifting capability as discussed above, the first parasitic may be referred to herein as a frequency shifting conductor or tuning conductor. A second parasitic element is located outside of the antenna volume and adjacent to the antenna radiator and disposed far enough away to minimize reactive coupling while maintaining proximity sufficient for influencing antenna radiation pattern characteristics, the second parasitic element may be alternatively referred to as a shifting conductor since it acts to shift the phase of the radiation pattern.

In a receive diversity scheme, the antenna illustrated in FIG. 3(*b*) is adapted to switch between a first antenna mode (first and second parasitic elements disconnected from ground) and a second antenna mode (second parasitic element short-circuited) as described above. In one embodiment, the receiver is adapted to receive a signal from the antenna operating in the first antenna mode for an extended duration until the signal may fade below a determined threshold, wherein the antenna is adapted to switch to operation in the second antenna mode upon such a signal fade to maintain a robust link.

Although the first parasitic element is described as maintaining an open-state in both the first and second antenna modes, it is possible to configure the antenna to disconnect the first parasitic element. Where dynamic tuning of the frequency response is desired, it may be preferred to provide a variable reactance by inserting a tunable capacitor in place of a switching component connecting the first parasitic to the baseband control signal.

It should be understood that although the representative illustrations depict an IMD antenna radiator, a planar inverted F-antenna (PIFA), meanderline, or other antenna radiator may be similarly configured for modal diversity applications.

FIGS. 4(*a-e*) further illustrate the return loss and efficiency of a null steering antenna adapted for receive diversity according to at least one embodiment of the invention as depicted in FIGS. 3(*a-b*). In a first antenna mode as described above, the first and second parasitic elements are disconnected from ground and the resulting return loss and efficiency plots are represented by FIGS. 4*a* and 4*b*. Similarly, in a second antenna mode as described above, the second parasitic element is short-circuited thereby varying a current mode of the antenna and altering the radiation pattern thereof. FIGS. 4(*c-d*) represent return loss and efficiency plots according to the second antenna mode of the antenna as described in FIGS. 3(*a-b*). FIG. 4*e* represents efficiency and correlation coefficients of the antenna according to both the first and second modes.

Figure 5:
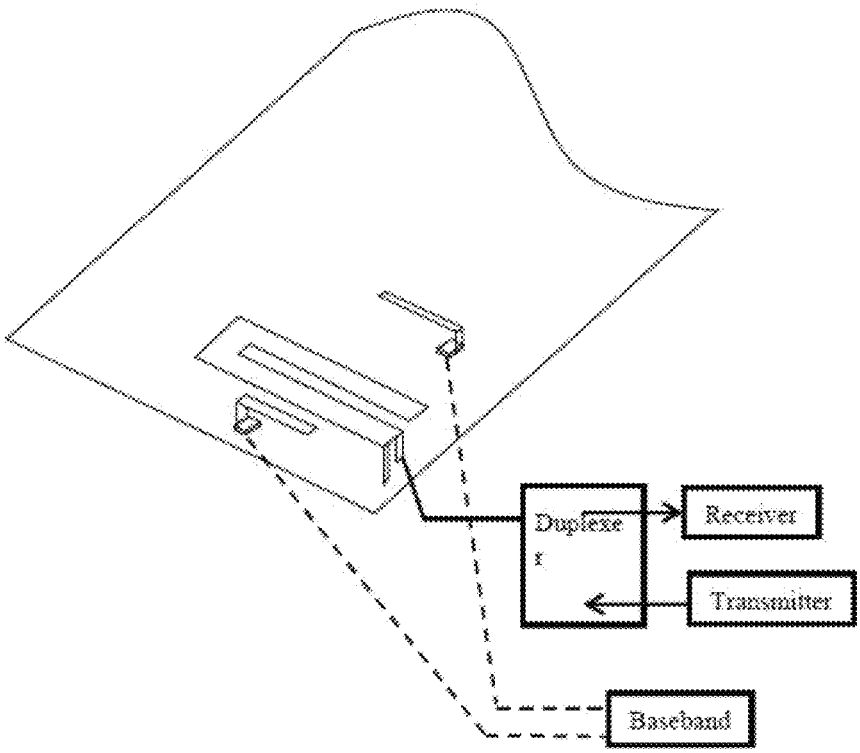
FIG. 5 illustrates an alternative embodiment of the null-steering antenna of FIG. 3(*b*) as adapted for diversity applications; the first and second parasitic elements are positioned in opposing alignment with respect to one another.

In another embodiment of the invention as further illustrated in FIG. 5, the modal antenna includes a first parasitic element positioned within a volume of the radiating structure and a second parasitic element positioned outside of the volume of the radiating structure and adjacent thereto. Each of the parasitic elements is individually connected to an active element, such as a switch, tunable capacitor, or other active element. Each of the active elements and attached parasitics are controlled by a baseband control signal. The first parasitic element is substantially contained within a volume of the antenna and aligned substantially parallel therewith. The second parasitic element is oriented in an opposing direction with respect to the first parasitic element. In this regard, the first and second parasitic elements can be individually aligned to provide for an ideal variation in radiation patterns over multiple modes. The alignment of the first and second parasitic elements is not limited to the embodiments illustrated in FIG. 5, and may in fact be designed for optimum radiation pattern characteristics over multiple antenna modes.

Figure 6:
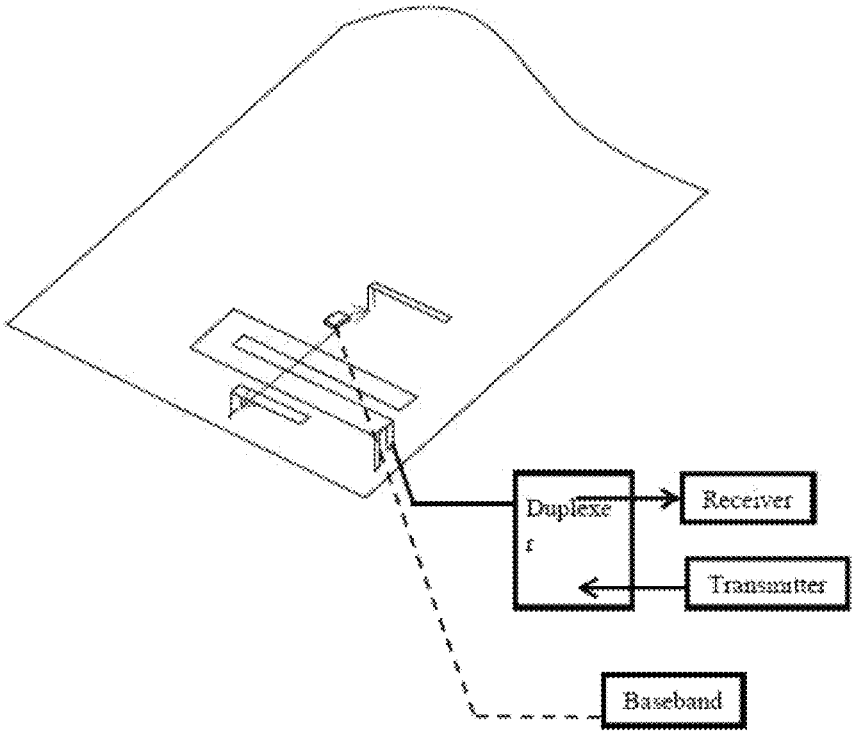
FIG. 6 illustrates an alternative embodiment of the null-steering antennas of FIGS. 3(*b*) and 5; the antenna comprising a common active element for controlling the parasitic elements.

In certain embodiments, a single active element may be utilized as illustrated in FIG. 6. Here, a modal antenna is provided comprising an antenna radiator having an antenna volume associated between the radiator and a circuit board. A first parasitic element is positioned within the antenna volume. A second parasitic element is positioned outside of the antenna volume yet adjacent to the radiator. An active element connects both parasitic elements to a common connection, such as a ground connection or tuning circuit. A baseband signal is provided to the active element for dynamic control of the antenna. In this regard, the parasitic elements are adapted to switch on/off according to the baseband signal.

Figure 7:
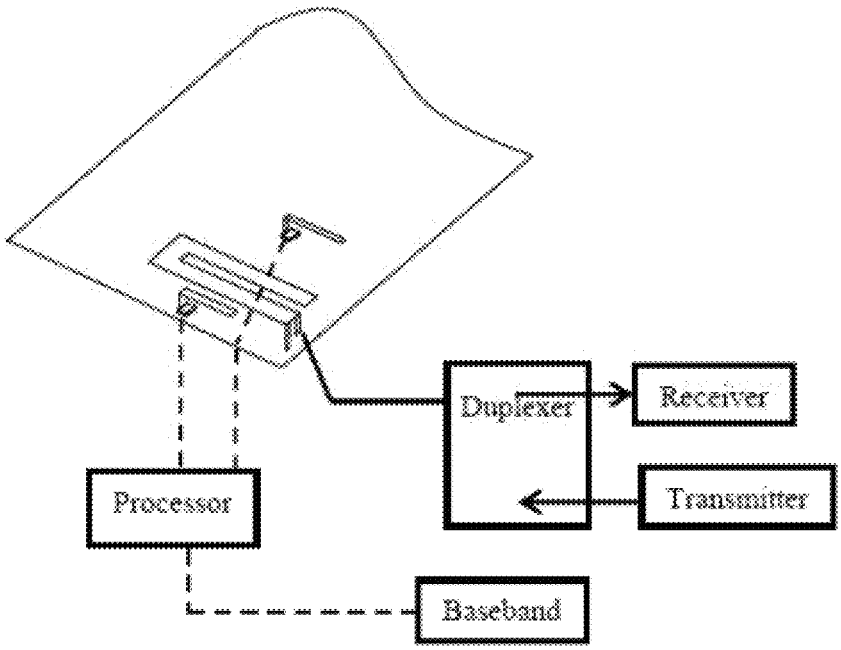
FIG. 7 illustrates a dynamic null-steering antenna adapted for diversity applications; the antenna includes a processor connected to active elements and attached parasitic elements providing adjustable reactive loading for tuning the frequency response of the antenna over multiple antenna modes.

In another aspect of the invention, a processor can be incorporated into the antenna system for providing dynamic control of the antenna radiation pattern. As illustrated in FIG. 7, a modal antenna includes an antenna radiator positioned above a circuit board and forming an antenna volume therebetween. A first parasitic element is positioned within the antenna volume. A second parasitic element is positioned outside of the antenna volume and adjacent to the radiating structure. Each of the parasitic elements is individually attached to an active element. Each of the active elements are further connected to a processor and adapted to receive a baseband signal therefrom. The antenna radiator can be further connected to a duplexer for protecting sensitive receiver components, and a receiver and transmitter coupled to the duplexer. In this regard, a processor can control signals sent to each of the active elements of the parasitic elements for switching on/off or varying a reactance thereof.

Figure 8:
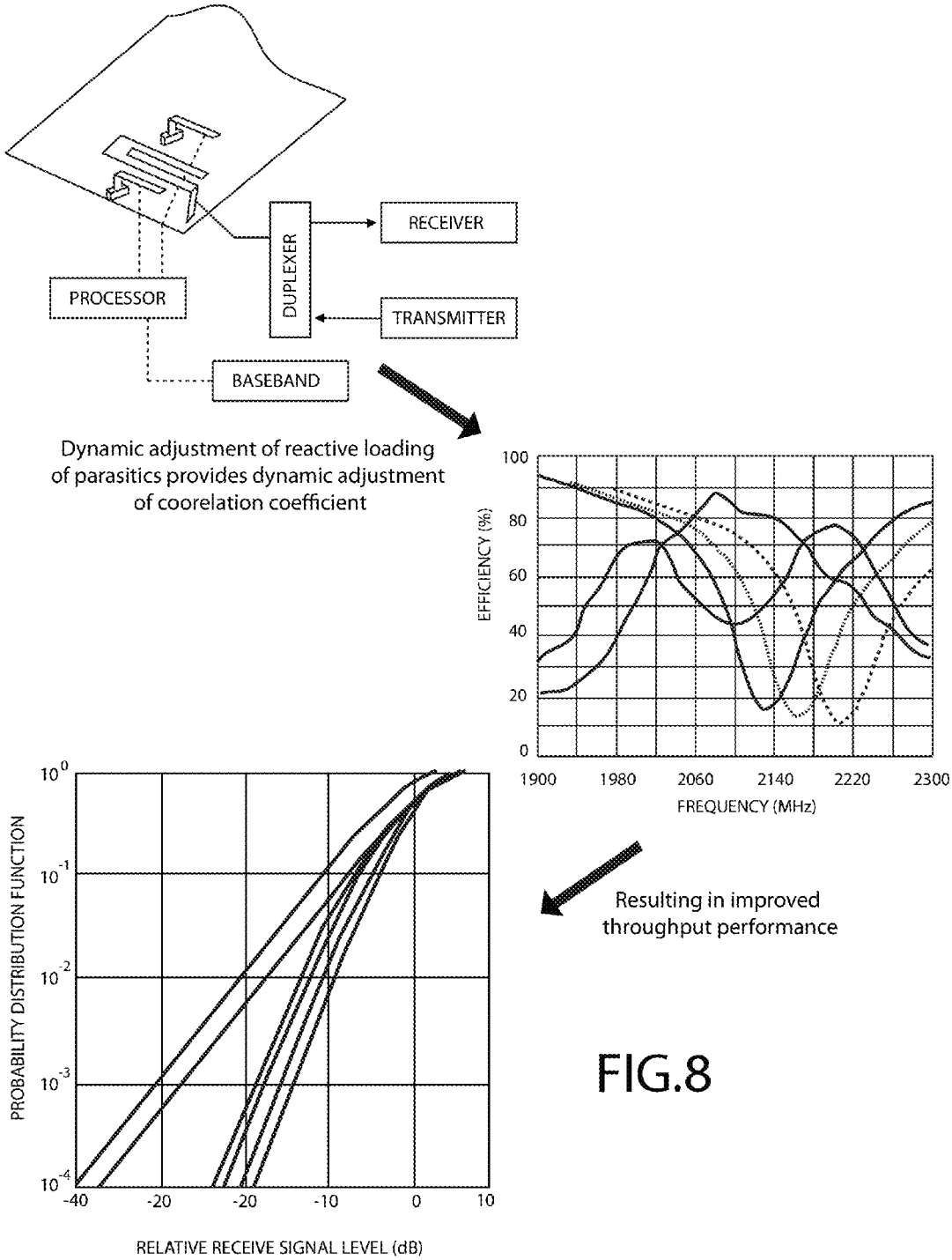
FIG. 8 is a diagram illustrating the performance enhancement provided by dynamic loading of a null-steering antenna adapted for diversity applications.

FIG. 8 further illustrates the antenna system of FIG. 7 and the resulting variations in correlation coefficient for various modes of the antenna. Here, a dynamic adjustment of reactive loading on each of the parasitic elements provides a corresponding dynamic adjustment of the antenna correlation coefficients over multiple modes. This technique provides for improved throughput performance.

Figure 9:
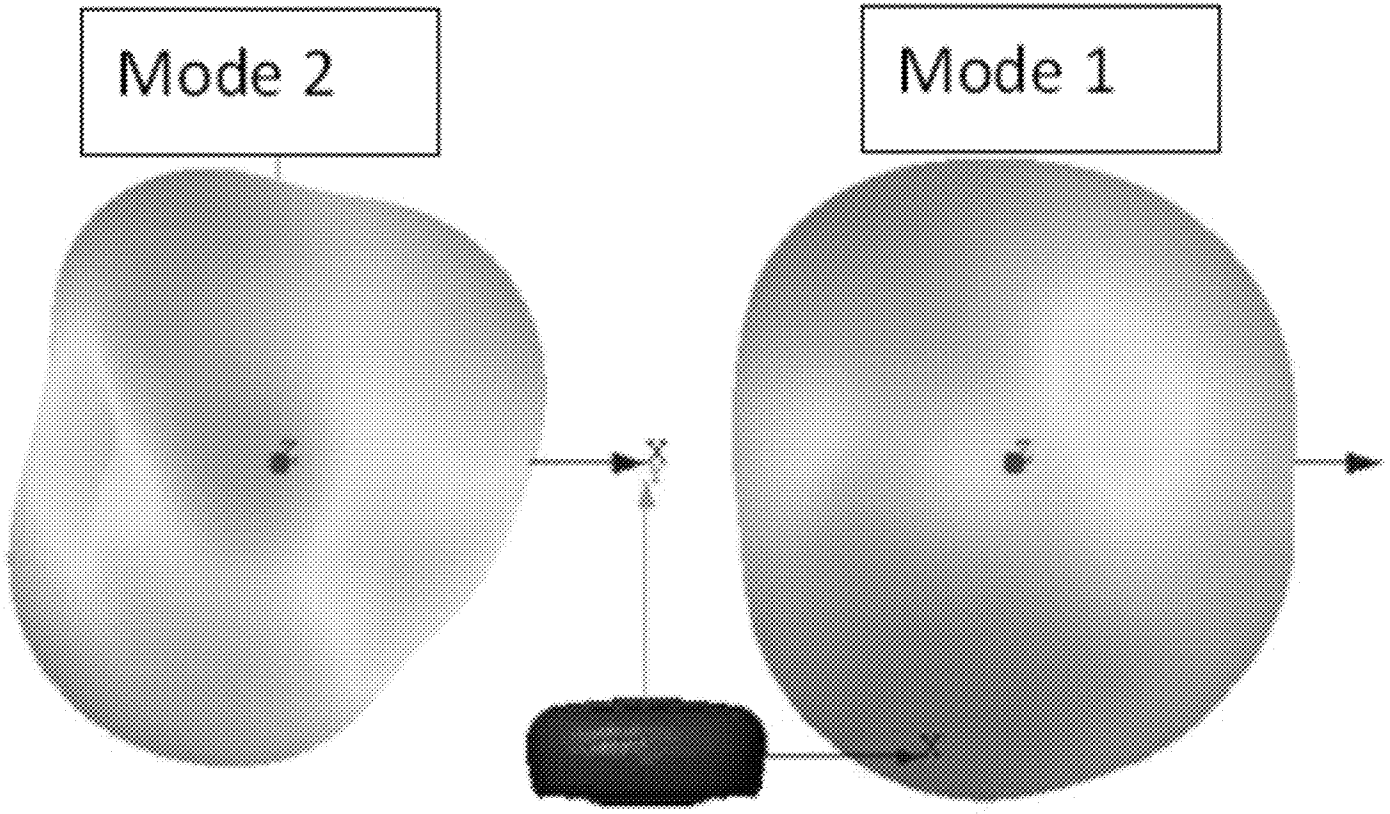
FIG. 9 illustrates 3-dimensional radiation patterns according to each of the two antenna modes as experienced according to the antenna of FIG. 3(*b*).

FIG. 9 illustrates a three-dimensional representation of the radiation pattern associated with the antenna of FIG. 7 according to a first mode and a second mode as described above.

Figure 10:
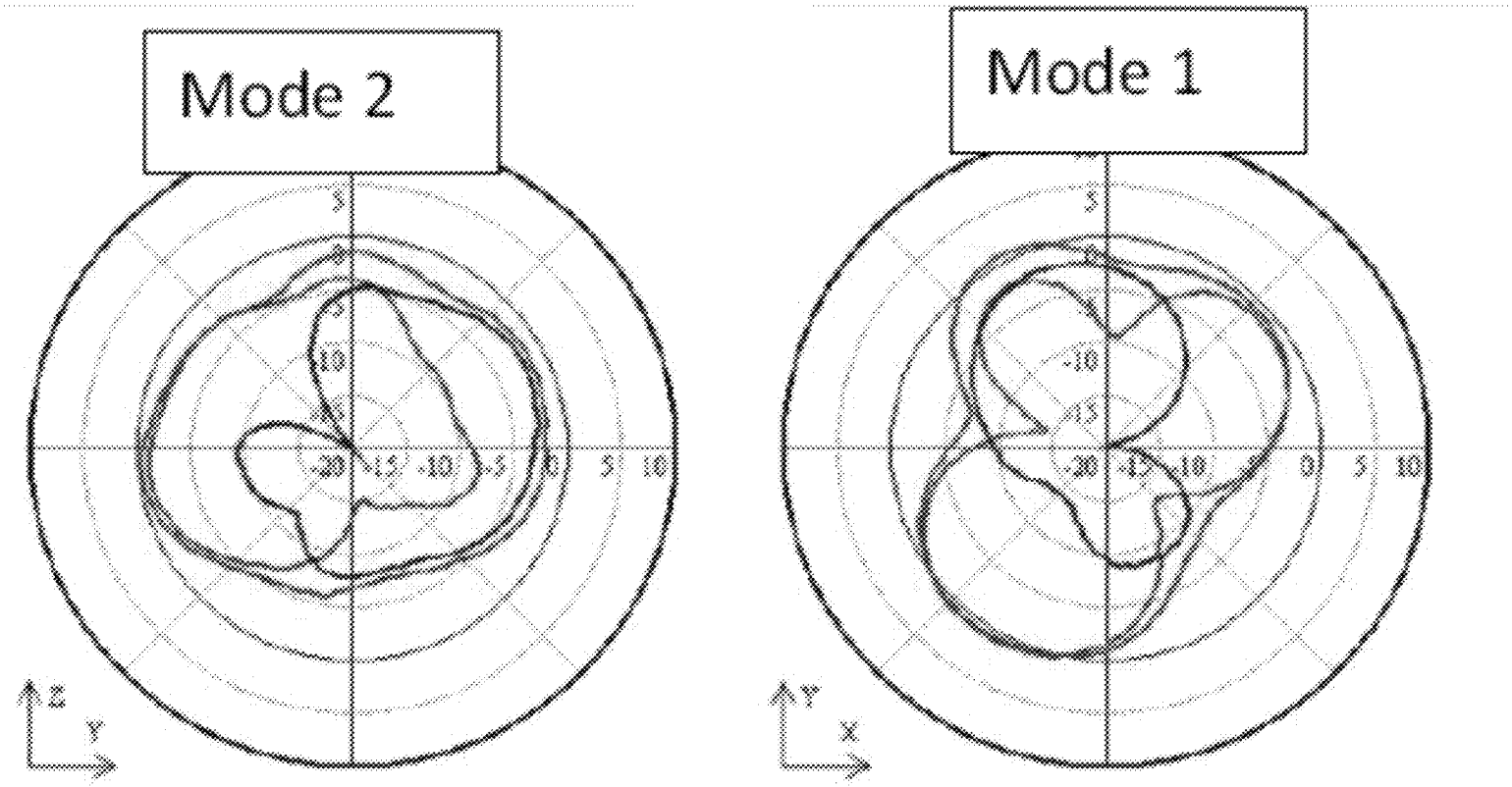
FIG. 10 illustrates 2-dimensional radiation patterns according to each of the two antenna modes as experienced according to the antenna of FIG. 3(*b*).

FIG. 10 illustrates the change in radiation pattern shape that can be realized from a two state null steered antenna configuration. The two dimensional radiation pattern shows the radiated field components in one of the principal planes. The Blue and green traces are the orthogonal linear components of the radiated field, with the red trace representing the combined radiated field. The null location in the blue trace rotates by 135 degrees between modes 1 and 2 while two of the three null regions in the green trace in mode 1 are filled when mode 2 is implemented.

Figure 11:
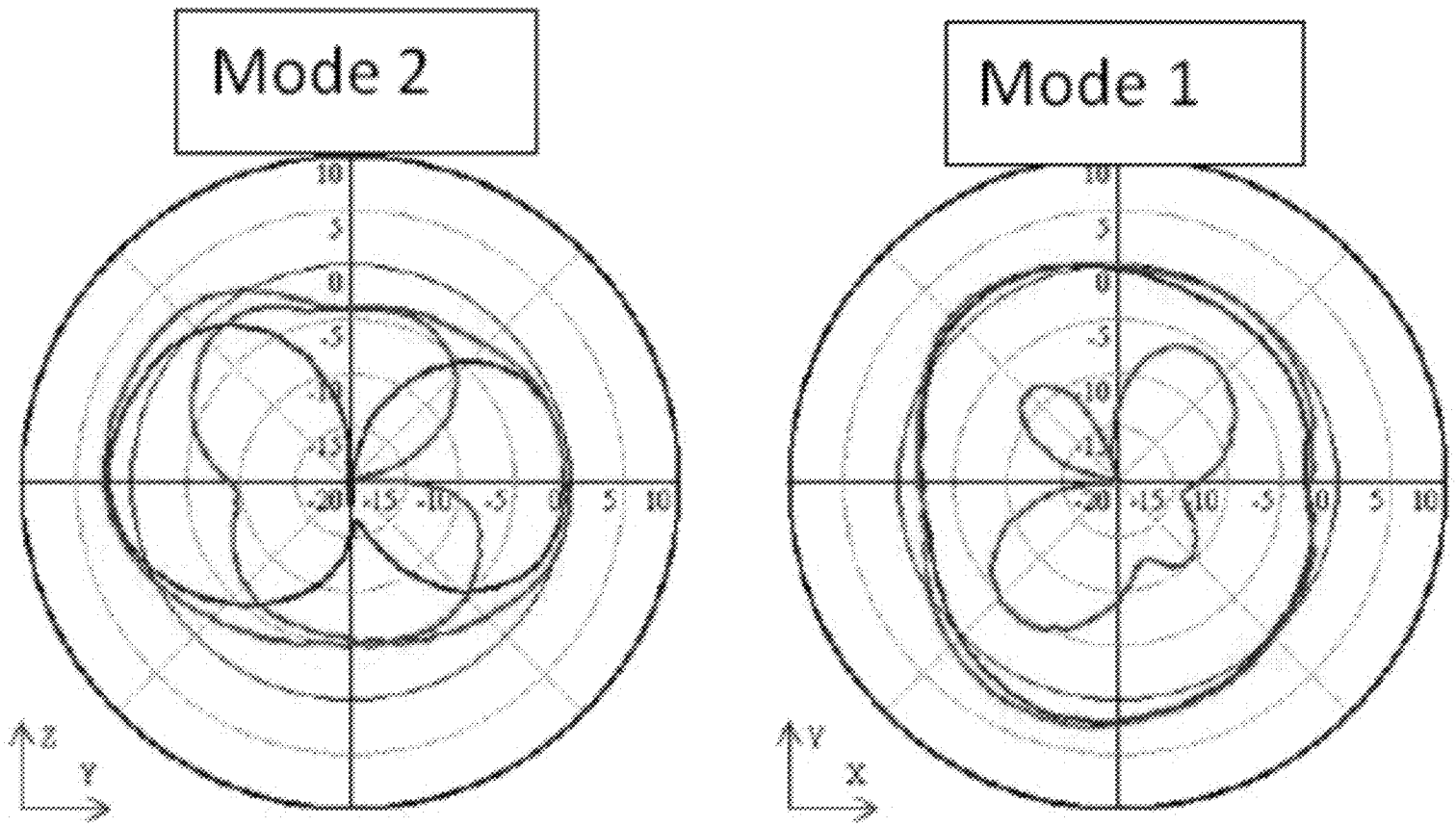
FIG. 11 illustrates 2-dimensional radiation patterns according to each of the two antenna modes as experienced according to the antenna of FIG. 3(*b*).

FIG. 11 illustrates the change in radiation pattern shape that can be realized from a two state null steered antenna configuration in a second principal plane. In this plane a substantial change in polarization can be seen when comparing the radiation patterns of mode 1 and mode 2.

Figure 12:
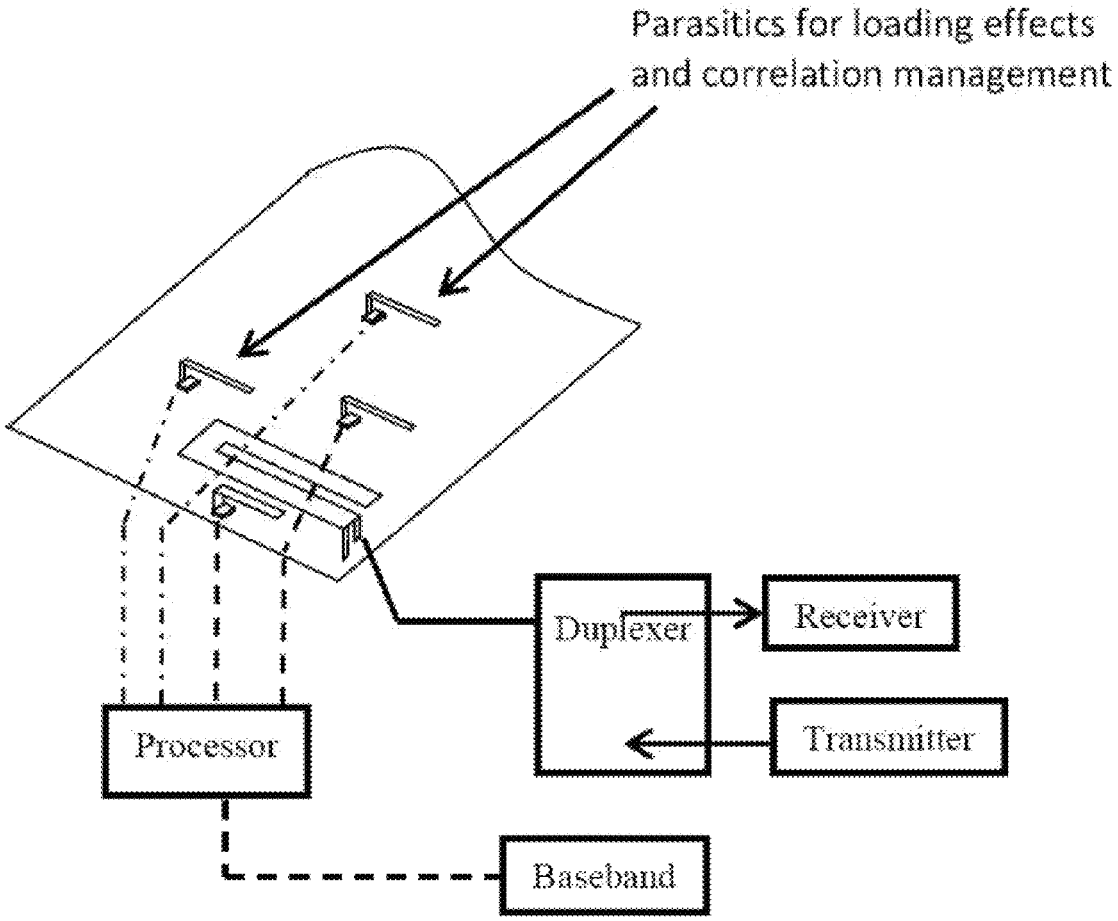
FIG. 12 illustrates a dynamic null-steering antenna adapted for diversity applications where two additional parasitic elements are implemented to provide additional capability to optimize antenna performance over a wide variety of environmental conditions, such as the mobile device in user's hand, against the user's head, or positioned on a wood, metal, or plastic surface. The antenna includes a processor connected to active elements and attached parasitic elements providing adjustable reactive loading for tuning the frequency response of the antenna over multiple antenna modes.

In another embodiment of the invention, multiple parasitic elements can be incorporated into the antenna as depicted in FIG. 12. Here, each of the multiple parasitic elements is connected to a processor for dynamic adjustment of the antenna. One or more parasitic elements can be adjusted by the processor according to a baseband control signal. A plurality of parasitic elements can provide a variety of loading effects and correlation management to the overall antenna system.

Modal Antenna Adapted for Transmit Diversity Application at Single Frequency

In another embodiment, the antenna can be configured for transmit diversity at a single frequency band. In this regard a transmission state can be similarly diversified by providing a single radiator adapted for operation at multiple antenna modes. In essence, the transmit diversity is an analogue to the receive diversity architectures described above.

Modal Antenna Adapted for Transmit/Receive Diversity at Single Frequency

Figure 13:
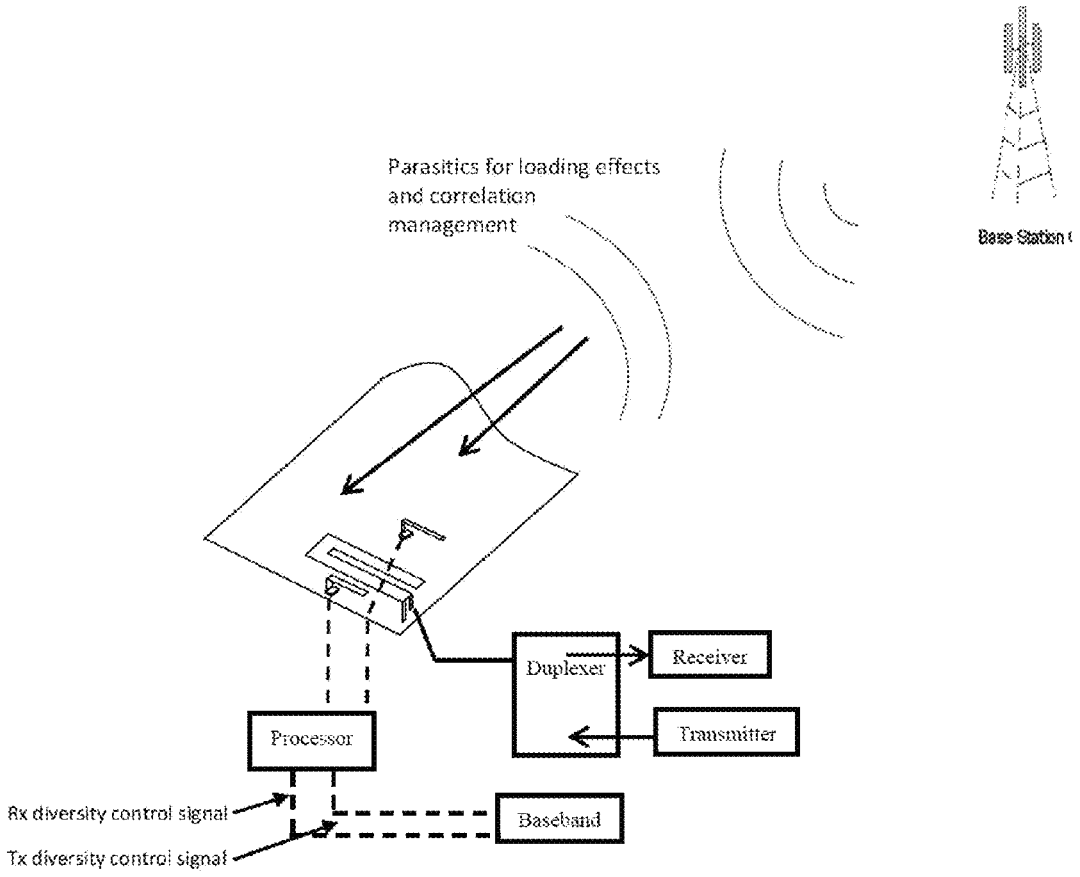
FIG. 13 illustrates a dynamic null-steering antenna adapted for both transmit and receive diversity applications. A metric related to communication link quality is received at the mobile device and is used to determine which antenna radiation pattern state is optimal.

In another aspect of the invention, a modal antenna is adapted for transmit/receive diversity as illustrated in FIG. 13. The antenna includes a radiator element positioned above a circuit board and forming a volume of the antenna therebetween. A first parasitic element is disposed within the volume of the antenna, and a second parasitic element is positioned outside of the antenna volume and adjacent thereto. Each of the parasitic elements of the antenna is coupled with an active element. The active elements are in communication with a processor. The antenna is further connected to a transmitter and receiver via a duplexer or similar component. An additional control signal is required from the other side of the communication link, in the case of a cellular application this is the base station. This control signal provides a metric which is a measure of communication link quality; this can be bit error rate (BER), signal to noise ratio (SNR), or throughput. To incorporate the transmit frequencies into a receive diversity antenna system, a variable reactance might be required on one or both parasitic elements to optimize the antenna element/offset parasitic pair as a function of frequency.

Although illustrated having a single parasitic element within the antenna volume and a single parasitic element offset from the antenna, the antenna of FIG. 13 can be modified to include multiple parasitic elements disposed at various positions and orientations for inducing optimum radiation characteristics of the antenna system. Additionally, each of the parasitic elements can be disposed at a distinct height or distance from the circuit board.

In certain embodiments, a variety of active elements, such as switches, voltage controlled tunable capacitors, voltage controlled tunable phase shifters, varactor diodes, PIN diodes, MEMS switches, MEMS tunable capacitors, BST tunable capacitors, and FET's can be implemented with the above-described null steering antennas for providing tuning across multiple frequency bands.

In certain embodiments of the invention, a radiating structure can be at least partially disposed above a ground plane. In other embodiments, no ground plane is required beneath the antenna radiator. A ground plane is optional for positioning beneath the antenna, however certain embodiments may benefit from reduced fringing fields when using an Isolated Magnetic Dipole above a ground plane.

In certain other embodiments, a processor may be included for dynamic control of the antenna. The processor can be preprogrammed with one or more algorithms for controlling antenna performance. For example, the processor can switch on or off a first active element in accordance with a baseband control signal. Alternatively, a reactance can be provided to one or more conductors according to the processor and a baseband control signal. In this regard, a processor provides multi-tier control and variability with respect to antenna performance.

In another embodiment, an algorithm is provided for residing in Baseband processor, where receive signal performance metric is sampled for both antenna modes and the reactance generated by the active component connected to one or both tuning and second parasitic elements is adjusted to improve receive performance. Successive reactance values are sampled during successive intervals on the mode not being used, or inactive mode, to improve receive performance prior to switching to the mode for use as the receive antenna.

Figure 14:
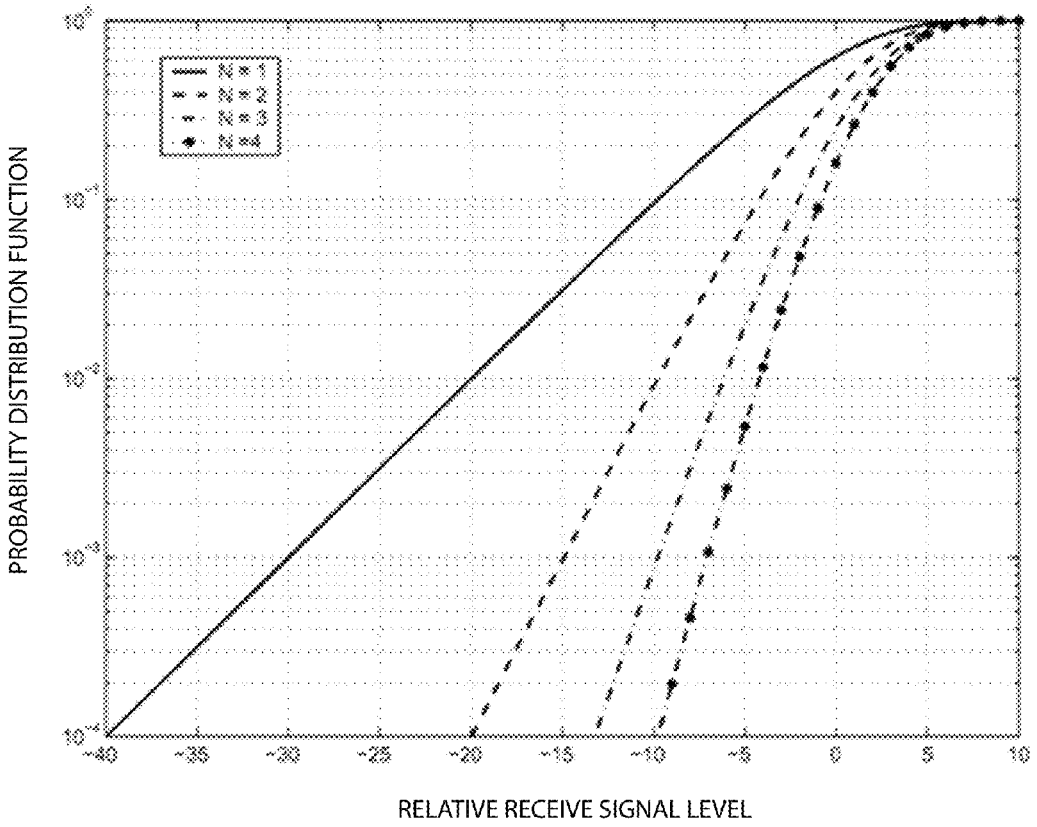
FIG. 14 illustrates the increase in receive signal level as a function of number of antennas used in a selection combining receive diversity scheme. The receive signal level is shown versus the probability distribution function.

FIG. 14 illustrates the increase in receive signal level as a function of number of antennas used in a selection combining receive diversity scheme. Receive performance of selection combining diversity scheme is represented as a function of multiple antennas N. The receive signal level is shown versus the probability distribution function.

Figure 15:
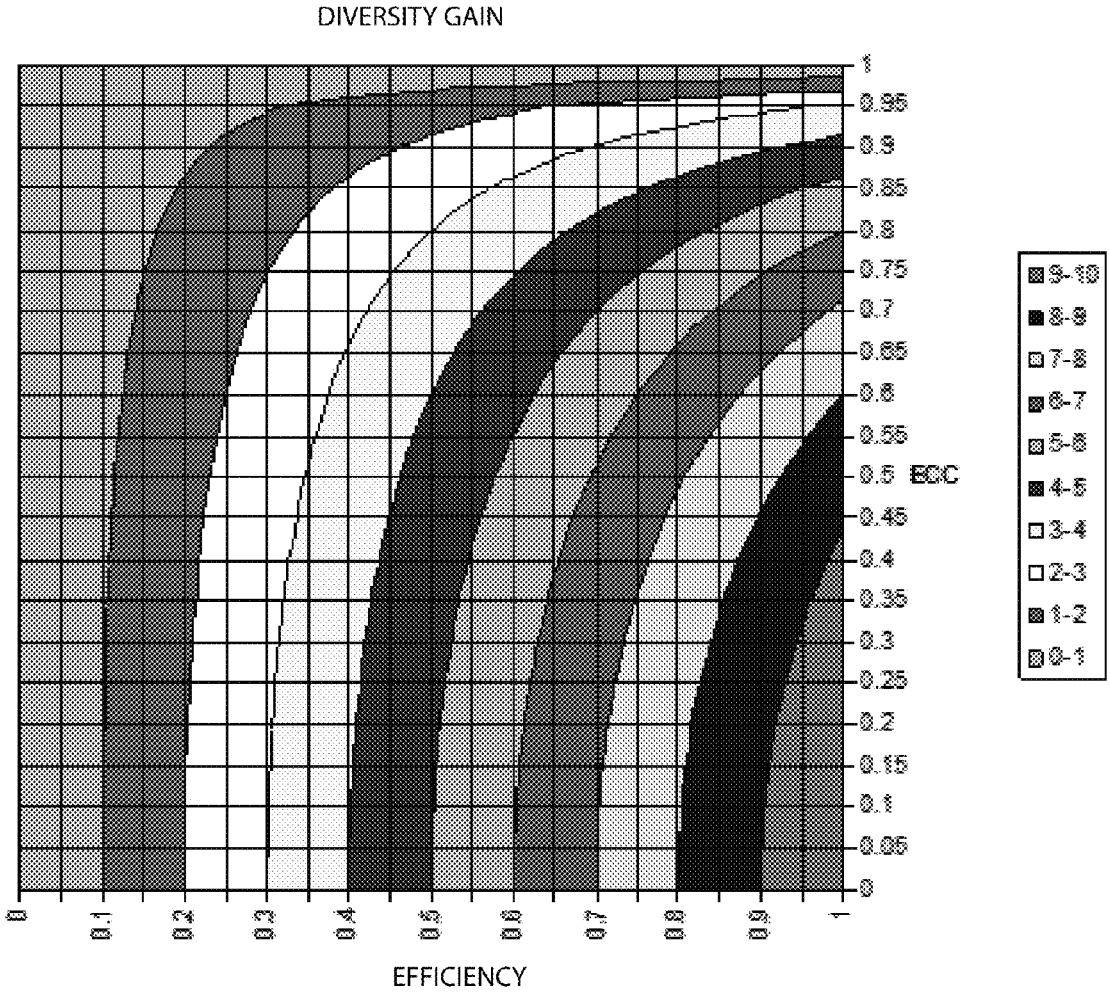
FIG. 15 illustrates the relationship between antenna efficiency, envelope correlation coefficient, and diversity gain for a two antenna diversity scheme. The colored contours are regions of constant diversity gain. This plotting of antenna efficiency and ECC provides information needed to design and/or dynamically tune a diversity antenna scheme.

FIG. 15 illustrates the relationship between antenna efficiency, envelope correlation coefficient, and diversity gain for a two antenna diversity scheme. Relationship between Envelope Correlation Coefficient and Antenna Efficiency; colored contours are regions of equal diversity gain. The shaded contours are regions of constant diversity gain. This plotting of antenna efficiency and ECC provides information needed to design and/or dynamically tune a diversity antenna scheme.

What is claimed is:

1. A method for designing a modal antenna for diversity applications, comprising:

providing an antenna radiator disposed above a circuit board and forming an antenna volume therebetween, positioning a first parasitic element within said antenna volume, said first parasitic element attached to a first active element for varying a reactance of the antenna;

positioning a second parasitic element outside of said antenna volume and adjacent to said antenna radiator, said second parasitic element attached to a second active element for varying a current mode thereon; and providing a control signal for actively configuring said first and second active elements and associated conductors.

2. The method of claim 1, further comprising the step:

optimizing a distance and orientation of said first parasitic element with respect to said antenna radiator for operation at a desired frequency band.

3. The method of claim 2, further comprising the step:

optimizing a distance and orientation of said second parasitic element with respect to said antenna radiator for providing a split resonance frequency characteristic of the antenna.

4. The method of claim 3, further comprising the step:

connecting said second parasitic element to ground for generating a split resonance frequency characteristic of the antenna.

5. The method of claim 4, further comprising the step:

varying a reactance of said first parasitic element for shifting said split resonance frequency of the antenna.

6. The method of claim 1, wherein said first and second active elements are individually selected from the group consisting of: switches, voltage controlled tunable capacitors, voltage controlled tunable phase shifters, varactor diodes, PIN diodes, MEMS switches, MEMS tunable capacitors, BST tunable capacitors, and FET's.

7. The method of claim 1, further comprising the step of:

adapting said antenna for operation at a first antenna mode, wherein said first antenna mode is effectuated by said second parasitic element being disconnected from ground.

8. The method of claim 7, further comprising the step of:

adapting said antenna for operation at a second antenna mode, wherein said second antenna mode is effectuated by said second parasitic element being connected to ground.

9. The method of claim 1, wherein the first parasitic element and first active element are adapted to provide beam steering capability, and wherein the second parasitic element and second active element are adapted to provide frequency tuning capability associated with said antenna.

10. The method of claim 1, where an additional active element is coupled to the antenna to provide dynamic impedance matching for optimizing antenna performance.

11. The method of claim 1, further comprising an additional second parasitic element for steering a radiation pattern associated with the antenna.

12. An antenna system adapted for multi-band operation and null steering, comprising:

a first null steering antenna comprising: a first radiating structure positioned above a circuit board and forming a first antenna volume therebetween, a first parasitic element positioned within said first antenna volume, and a second parasitic element positioned outside of said first antenna volume and adjacent to said first radiating structure;

a second null steering antenna comprising: a second radiating structure positioned above a circuit board and forming a second antenna volume therebetween, a third parasitic element positioned within said second antenna volume, and a fourth parasitic element positioned outside of said second antenna volume and adjacent to said second radiating structure;

wherein said first null steering antenna is optimized for the transmit band of the AWS frequency band ranging between 1710 and 1755 MHz; and wherein said second null steering antenna is optimized for the receive band of the AWS frequency band ranging between 2110 and 2155 MHz.

13. An antenna system, comprising:

a radiating structure positioned above a circuit board and forming an antenna volume therebetween;

a first parasitic element positioned within said antenna volume and associated with a first active element; and a second parasitic element positioned outside of said antenna volume and adjacent to said radiating structure, said second parasitic element associated with a second active element;

a processor adapted for communication with said first and second active elements;

wherein said processor is adapted to receive a control signal and dynamically control said first and second active elements; and wherein said processor comprises an algorithm adapted to sample a receive signal performance metric associated with multiple antenna modes.

14. The antenna system of claim 13, wherein a reactance generated by at least one of said active elements of said first and second parasitic elements is adjusted to improve receive performance.

15. The antenna system of claim 14, wherein successive reactance values are sampled during successive intervals on an inactive mode to improve receive performance prior to activating said inactive mode for use as the receive antenna.

* * * * *